US008888615B2

(12) United States Patent
Hulbert et al.

(10) Patent No.: US 8,888,615 B2
(45) Date of Patent: Nov. 18, 2014

(54) ROTATABLE AND HINGED GOAL POSTS

(75) Inventors: Eric W. Hulbert, Walton, NY (US); Bob J. Barriger, Sidney Center, NY (US); John K. Barriger, Unadilla, NY (US); Daniel J. Sovocool, Sidney Center, NY (US)

(73) Assignee: Sportsfield Intellectual, LLC., Delhi, NY (US)

( * ) Notice: Subject to any disclaimer, the term of this patent is extended or adjusted under 35 U.S.C. 154(b) by 180 days.

(21) Appl. No.: 13/218,041

(22) Filed: Aug. 25, 2011

(65) Prior Publication Data

US 2012/0052991 A1 Mar. 1, 2012

Related U.S. Application Data

(60) Provisional application No. 61/377,735, filed on Aug. 27, 2010.

(51) Int. Cl.
*A63B 63/00* (2006.01)
*A63B 71/00* (2006.01)

(52) U.S. Cl.
CPC ..... *A63B 63/008* (2013.01); *A63B 71/0036* (2013.01)
USPC ..... 473/477

(58) Field of Classification Search
CPC ..... A63B 63/008; A63B 63/004
USPC ..... 473/476, 477, 478; 248/349.1, 415; 199/66; 269/74, 304; 408/71, 221; 74/822; 89/36.13, 37.17
See application file for complete search history.

(56) References Cited

U.S. PATENT DOCUMENTS

| | | | | |
|---|---|---|---|---|
| 263,415 | A | 8/1882 | Lightburne, Jr. | |
| 271,054 | A * | 1/1883 | Fowler | 108/139 |
| 333,210 | A | 12/1885 | Fisher | |
| 421,532 | A | 2/1890 | Van Dorn | |
| 519,311 | A | 5/1894 | Andrew | |
| 648,512 | A | 5/1900 | Manley | |
| 757,824 | A * | 4/1904 | Martin | 191/66 |
| 1,071,585 | A | 8/1913 | Rossell | |

(Continued)

FOREIGN PATENT DOCUMENTS

| | | |
|---|---|---|
| CN | 201232387 | 5/2009 |
| FR | 2713943 | 6/1995 |
| WO | 2011/109437 | 9/2011 |

OTHER PUBLICATIONS

Webpage download, GilmanGear, 2007, web.archive.org/web/20070312011101/http://gilmangear.com/, 3 pages.*

(Continued)

*Primary Examiner* — Gene Kim
*Assistant Examiner* — M Chambers
(74) *Attorney, Agent, or Firm* — Heslin Rothenberg Farley & Mesiti P.C.

(57) ABSTRACT

Rotatable and hinged goal posts are operably rotatable so that the goal post may rotated to a first position with the uprights being disposed toward a playing field such as for use when playing football, and to second position where the uprights being disposed away from the playing field such as for use when playing soccer. In addition, the rotatable and hinged goal posts are operably pivotable from a raised orientation and a lowered orientation, and vice versa.

39 Claims, 9 Drawing Sheets

(56) References Cited

U.S. PATENT DOCUMENTS

| | | | | | |
|---|---|---|---|---|---|
| 1,267,117 | A | | 5/1918 | Riotte et al. | |
| 1,645,218 | A | | 10/1927 | Boye | |
| 2,074,125 | A | | 3/1937 | Lefft et al. | |
| 2,151,146 | A | | 3/1939 | Petry | |
| 2,175,752 | A | | 10/1939 | Gray | |
| 2,216,408 | A | | 10/1940 | Elmer | |
| 2,246,891 | A | | 6/1941 | Moise | |
| 2,567,243 | A | | 10/1949 | Smith | |
| 2,521,368 | A | | 9/1950 | Hingerty, Jr. | |
| 2,694,540 | A | | 11/1954 | Pfaff, Jr. | |
| 2,701,605 | A | | 2/1955 | Belmont | |
| 2,991,495 | A | | 10/1958 | Blalak | |
| 2,884,252 | A | | 4/1959 | Thompson | |
| 2,929,630 | A | | 3/1960 | Simmons | |
| 3,083,680 | A | | 4/1963 | Willis, Jr. et al. | |
| 3,138,010 | A | | 6/1964 | Shipley et al. | |
| 3,209,720 | A | | 10/1965 | Campbell et al. | |
| 3,311,333 | A | * | 3/1967 | Galloway | 52/295 |
| 3,345,826 | A | | 10/1967 | Hignite | |
| 3,364,635 | A | | 1/1968 | Guggemos | |
| 3,418,009 | A | | 12/1968 | Pollia | |
| 3,443,827 | A | | 5/1969 | Acker et al. | |
| 3,466,723 | A | * | 9/1969 | Durand | 29/897.33 |
| 3,516,666 | A | | 6/1970 | Trimble et al. | |
| 3,550,938 | A | | 12/1970 | Cunnigham, Jr. | |
| 3,802,653 | A | | 4/1974 | Nyulassie | |
| 3,820,787 | A | | 6/1974 | Heinbigner | |
| 3,856,302 | A | | 12/1974 | Karkoska | |
| 3,981,501 | A | | 9/1976 | Gonzalez et al. | |
| 4,026,554 | A | | 5/1977 | Karkoska | |
| 4,079,559 | A | | 3/1978 | Tenbrummeler | |
| 4,820,211 | A | | 4/1989 | Onoue | |
| 4,878,160 | A | | 10/1989 | Reneau et al. | |
| 4,949,525 | A | | 8/1990 | Weaver | |
| 5,037,093 | A | | 8/1991 | Roark, Jr. | |
| 5,058,336 | A | | 10/1991 | Jenvey | |
| 5,060,989 | A | | 10/1991 | Gallucci et al. | |
| 5,186,469 | A | | 2/1993 | Terris | |
| 5,332,196 | A | | 7/1994 | Wright | |
| 5,429,350 | A | | 7/1995 | Meier | |
| 5,438,805 | A | | 8/1995 | McCrary | |
| 5,441,359 | A | | 8/1995 | Filippi | |
| 5,513,843 | A | | 5/1996 | Russell | |
| 5,584,480 | A | | 12/1996 | Grimsrud | |
| 5,685,343 | A | | 11/1997 | Smith | |
| 5,772,172 | A | | 6/1998 | Sampedro et al. | |
| 5,794,387 | A | | 8/1998 | Crookham | |
| 5,857,928 | A | | 1/1999 | Stewart | |
| 6,202,369 | B1 | | 3/2001 | Partee et al. | |
| 6,216,414 | B1 | | 4/2001 | Feldberg | |
| 6,375,585 | B1 | | 4/2002 | Driscoll | |
| 6,389,917 | B1 | | 5/2002 | Oberle | |
| 6,394,917 | B1 | | 5/2002 | Chiappini et al. | |
| 6,585,601 | B2 | | 7/2003 | Booker et al. | |
| 6,915,913 | B2 | | 7/2005 | Cardinell | |
| 6,945,885 | B2 | | 9/2005 | Snider | |
| 7,014,578 | B1 | | 3/2006 | Brodeur | |
| 7,252,605 | B2 | | 8/2007 | Snider | |
| 7,278,894 | B2 | | 10/2007 | Lyon et al. | |
| 7,331,880 | B2 | * | 2/2008 | Rogers | 473/478 |
| 7,351,168 | B1 | | 4/2008 | Pannell | |
| 7,458,328 | B2 | | 12/2008 | Hall | |
| 7,462,117 | B2 | | 12/2008 | White et al. | |
| 7,523,912 | B1 | * | 4/2009 | Woods | 248/415 |
| 7,914,401 | B2 | | 3/2011 | Hulbert | |
| 2003/0144091 | A1 | | 7/2003 | Dickson | |
| 2006/0199674 | A1 | | 9/2006 | Rogers | |
| 2009/0156334 | A1 | | 6/2009 | Cucchiara et al. | |
| 2012/0052991 | A1 | * | 3/2012 | Hulbert et al. | 473/477 |

OTHER PUBLICATIONS

RoyalHigh2013, 2004 video screen shots, http://www.youtube.com/watch?v=0PZzd6QGSic, 9 pages.*

AAE, 2004 catalog pages, 2004, 5 pages.*

Design Specifications for Model #SEF305 High School 8 FT Football Goal, published prior to Jun. 28, 2007, 2 pages, United States.

WVU President Asks Fans to Behave, Pittsburgh Tribune Review—Sports, Nov. 11, 2003, 2 pages, Associated Press, United States.

Athletic Tools and Equipment, web pages from www.courtandsports.com, published prior to Jul. 17, 2007, 2 pages, United States.

Miscellaneous Hardware Specifications and Installation Instructions, published prior to Dec. 18, 2007, 6 pages, Sportsfield Specialties Inc., United States.

Hinged Goal Post—Gilman Gear Online Store, web pages from www.nexternal.com, published prior to Jul. 17, 2007, 2 pages, United States.

International Preliminary Report on Patentability, issued on Sep. 4, 2012, for International Application PCT/US2011/026746, and published as WO2011/109437.

Webpage screen shots, Royal high School Soccer 2004, www.youtube.com/watch?v=0PZzd6QGSix, 9 pages, 2004.

Assembly Instructions, Football Goal Post with Ground Sleeve Installation Instructions, Sportsfield Specialties, 11 pages, 2010.

Hinged Goal Post, available from Gilman Gear, printout available online on Aug. 24, 2011 at http://web.archive.bibalex.org/web/20050303234902/www.gilmangear.com/store/catalog/hinged-goal-post-p-179.html, 1-page, 2005.

2006 AAE Catalog, Hinged Offset Football Goals, Aluminum Athletics Equipment Co., Royersford, Pennsylvania, pp. 1, 44, and 70, Nov. 2006.

AAE 8' Offset Football Goal (Hinged), available from Aluminum Athletic Equipment Co., Royersford, Pennsylvania, engineering drawings and assembly and instructions, printout available online on Aug. 24, 2011, at http://www.myaaeworld.com/att/44/store/u37_hsghs8.pdf, 12-pages, 2005.

SportsEdge Rotating Football Goal Brochure, Model Nos. SEF305R and SEF315R, available from SportsEdge, Troutman, North Carolina, printout available online on Aug. 23, 2011, at http://www.sportsedge.com/f/ROTATING_GOAL_Brochure.pdf, 5-pages, Apr. 22, 2010.

SportsEdge Rotating Football Goal Model No. SEF305R, available from SportsEdge, Troutman, North Carolina, engineering drawings, printout available online on Aug. 23, 2011, at http://www.sportsedge.com/f/Rotating_Goal_SEF305R.pdf, 1-page, Feb. 27, 2010.

SportsEdge Rotating Football Goal Model No. SEF308R, available from SportsEdge, Troutman, North Carolina, engineering drawings, printout available online on Aug. 23, 2011, at http://www.sportsedge.com/f/Specs_Rotating_Goal_SEF308R.pdf, 1-page, Apr. 19, 2011.

SportsEdge Rotating Football Goal Model No. SEF305R, available from SportsEdge, Troutman, North Carolina, Football Product Specifications, printout available online on Aug. 23, 2011, at http://www.sportsedge.com/Football_Products/Specifications/, 4-pages, Jan. 17, 2011.

Sportsfield Specialties Goal Line Products Brochure, 4600 College/Pro and 4800 High School Goals (plate mounted) Football Goal Posts, available at http://web.archive.org/web/20070709202434/www.sportsfieldspecialties.com/PDF +Brochures/SSI+Goal+Post+Brochure.pdf (obtained via search of: http://web.archive.org/web/*/www.sportsfieldspecialties.com), 4-page, 2007.

Hand Operated Hydraulic Pumps available from Brand Hydraulics, Omaha, Nebraska, printout available online on Aug. 23, 2011, at http://www.brand-hyd.com/hp/catalog.pdf, 4-pages, 2008.

Flow Regulator, Pressure Compensated, Model No. FR10-33, available from HydraForce, Inc., Lincolnshire, Illinois, printout available online on Aug. 23, 2011, at http://www.hydraforce.com/Flowcont/Flo-pdf/5-372-1.pdf, 3-pages, 2006.

* cited by examiner

ROTATABLE AND HINGED GOAL POSTS

CROSS-REFERENCE TO RELATED APPLICATION

This application claims the benefit of U.S. Provisional Application No. 61/377,735, filed Aug. 27, 2010, entitled "Rotatable And Hinged Goal Posts", which is hereby incorporated herein by reference in its entirety.

FIELD OF THE INVENTION

This invention relates generally to goal posts, and more specifically, to rotatable and hinged goal posts.

BACKGROUND

Typically, football goal posts have a generally U-shaped goal defined by a horizontal crossbar and two vertical uprights. The U-shaped goal post is usually supported by a gooseneck extending up from the ground. Often, the football goal post is a rigid structure permanently fixed in place on the field.

U.S. Patent Application Publication No. 2009/0156334 by Cucchiara discloses a football goal post that allows the football goal post to be rotated about a substantially vertical axis. The football goal post has a gooseneck-type post adapted to fit within a sleeve in the ground. The sleeve has one or more positioning members positioned near an upper end of the sleeve. A rotation collar is movably coupled to the post and has one or more grooves for cooperating with the one or more positioning members of the sleeve. The rotation collar is configured to move between a secured position, where the at least one groove engages the at least one positioning member to prevent the post from rotating within the sleeve, and a rotating position, where the at least one groove is disengaged from the at least one positioning member to permit the post to rotate within the sleeve.

U.S. Pat. No. 7,014,578 issued to Brodeur discloses an adjustable football goalpost assembly that can be used at various times by both high school and college teams by adjusting the spacing of the uprights. The assembly includes a sleeve that is inserted into a hole in a field, or in artificial or natural turf. The goalpost's gooseneck is then inserted into the sleeve. Slots at the top of the sleeve receive bolts and nuts that allow adjustment of the gooseneck in relation to the sleeve, in two orthogonal directions.

U.S. Pat. No. 6,394,917 issued to Chiappini et al. discloses a football goal post having a cross bar that allows the spacing of the uprights to be selectively adjusted by the user of the goal post. Also, discloses is an adjustable ground sleeve that allows the goal post to be raised and lowered and rotated about the x, y, and z axes so that it may be precisely aligned with the football field during and after installation.

Therefore, there is a need for further goal posts, and more specifically, to rotatable and hinged goal posts.

SUMMARY OF THE INVENTION

In a first aspect, the present invention provides a rotatable and hingable goal post. The rotatable and hingable goal post includes a cross member, a pair of spaced-apart uprights attachable to the cross member, and a support member having an upper portion and a lower portion. The upper portion of the support member is attachable to the cross member. A hinge and a rotatable device are operably connectable to the lower portion of the support member and to the ground. An actuator is operably attachable to the support member and operably attachable to the ground. The rotatable device is operable for rotating the rotatable goal post about the lower portion of the support member from a first position with the uprights disposed toward a playing field, and a second position with the uprights being disposed away from the playing field. The actuator is operable for controllably pivoting the goal post about an axis of the hinge from a first orientation with the uprights disposed vertically upward and the cross member spaced-apart from the ground, and a second orientation wherein the cross member is disposed and in contact with the ground, and the actuator is operable for controllably pivoting the goal post about the axis of the hinge from the second orientation to the first orientation.

In a second aspect, the present invention provides a method for moving a goal post. The method includes providing a goal post having a cross member, a pair of spaced-apart uprights attached to the cross member, and a support member having an upper portion and a lower portion, the upper portion attached to the cross member and the lower portion of the support is hingedly and rotatably attached to the ground, rotating the goal post about the support member from a first position with the uprights disposed toward a playing field to a second position with the uprights being disposed away from the playing field, pivoting goal post from a first orientation with the uprights disposed vertically upward and the cross member spaced-apart from the ground to a second orientation wherein the cross member is disposed and in contact with the ground, pivoting the goal post from the second orientation to the first orientation, and rotating the goal post about the support member from the second position to the first position.

In a third aspect, the present invention provides a rotatable and hingable goal post. The rotatable and hingable goal post includes a cross member, a pair of spaced-apart uprights attachable to the cross member, a support member having an upper portion and a lower portion. The upper portion of the support member is attachable to the cross member. A first plate is attachable to an end of the lower portion of the support member, a second plate is fixedly attachable to the ground, and a third plate is disposed between the first plate and the second plate. A rotatable device is disposable between the third plate and one of the first plate and the second plate. A hinge is operably attachable to the third plate and to the other of the first plate and the second plate. The rotatable device is operable for rotating the rotatable goal post about the lower portion of the support member from a first position with the uprights disposed toward a playing field, and a second position with the uprights being disposed away from the playing field. The hinge is operable for pivotally moving the goal post about an axis of the hinge from a first orientation with the uprights disposed vertically upward and the cross member spaced-apart from the ground, and a second orientation wherein the cross member is disposed and in contact with the ground.

In a fourth aspect, the present invention provides a rotatable goal post. The rotatable goal post includes a cross member, a pair of spaced-apart uprights attachable to the cross member, a support member having an upper portion and a lower portion which the upper portion attachable to the cross member, and a bearing comprising a plurality of rolling elements operably attachable to the lower portion of the support member and to a fixed support in the ground. The bearing operable for rotating said rotatable goal post about said lower portion of said support member about 180-degrees from a first position with said uprights disposed toward a playing field to a second position with said uprights being disposed away from the playing field.

In a fifth aspect, the present invention provides a hinged goal post. The hinged goal post includes a cross member, a pair of spaced-apart uprights attachable to the cross member, and a support member having an upper portion and a lower portion with the upper portion attachable to the cross member. A hinge hingedly attaches the lower portion of the support member to the ground. An actuator is operably attachable to the support member and operably attachable to the ground. The actuator is operable for controllably pivoting the goal post about an axis of the hinge from at least one of a first orientation with said uprights disposed vertically upward and the cross member spaced-apart from the ground to a second orientation wherein the cross member is disposed and in contact with the ground, and from the second orientation to the first orientation.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION

The present invention in one or more aspects is directed to goal posts that may be operably rotated about a vertical portion of the gooseneck. For example, the goal post may be positionable in a first vertical position with the uprights being disposed toward a playing field such as for use when playing football, and rotatable 180-degrees to a second vertical position with the uprights being disposed away from the playing field such as for use when playing soccer. The goal post may be returned to the first position by rotating the goal post back 180-degrees, or continuing to rotate the goal post another 180-degrees (e.g., a total of 360-degrees) for use when playing football. In addition, the present invention in other aspects is directed goal posts that may be capable of being operably pivoted from a raised or upright orientation to a lowered orientation, and vice versa. In further aspects, the present invention includes a combination of these two capabilities into one design allows for rotating and/or raising and lowering the goal posts.

Figure 2:
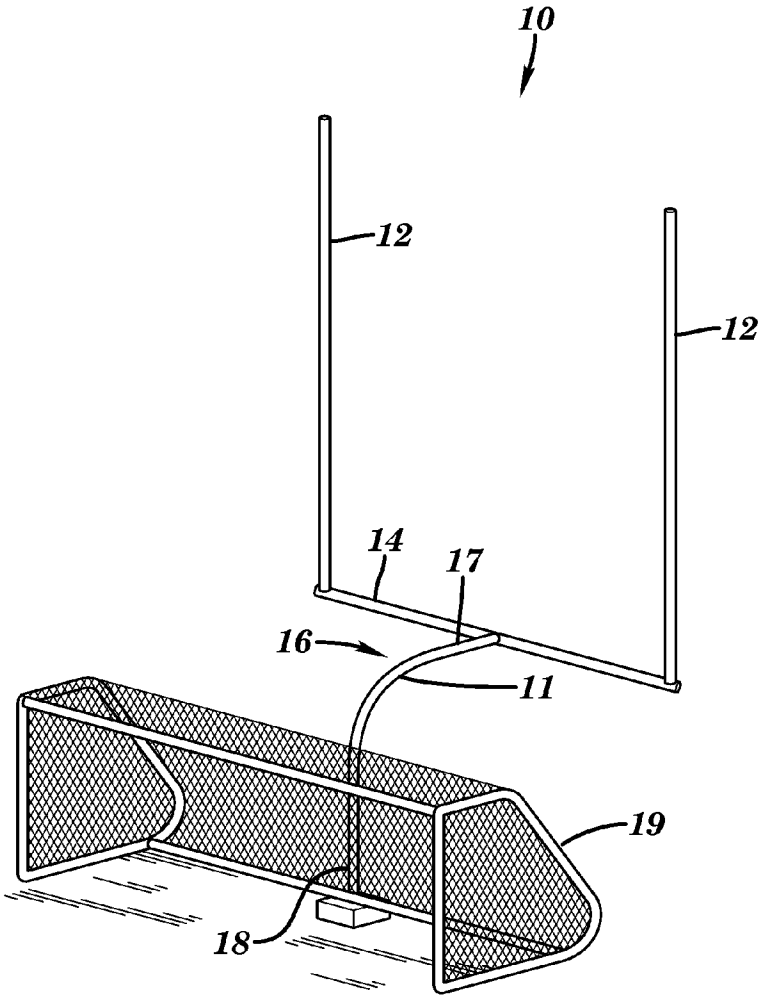
FIG. 2 is a perspective view of the rotatable and hinged goal post of FIG. 1 disposed in a second vertical position such as for use in playing soccer.
Figure 1:
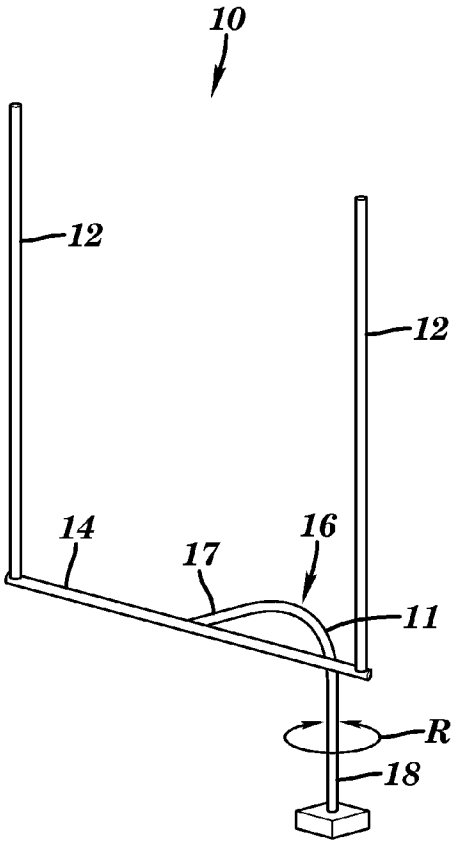
FIG. 1 is a perspective view of one embodiment of a rotatable and hinged goal post in accordance with the present invention disposed in a first vertical position such as for use in playing football.

FIGS. 1 and 2 illustrate one embodiment of a rotatable and hingable football goal post 10 in accordance with one or more aspects of the present invention. Goal post 10 may include a pair of spaced-apart vertical uprights 12 attachable to a horizontal cross member 14, and a support member 16, such as a curved support member or a gooseneck having an upper portion 17, a lower portion 18, and a curved portion 11 disposed therebetween. Upper portion 17 is attachable to cross member 14.

For example, goal post 10 may be typically positioned for use on a ground such as a natural or artificial or synthetic turf playing field for playing football as shown in FIG. 1. In addition, goal post 10, as described in greater detail below, may be operably rotated about the lower portion of support member 16, in either of the directions of the curved double arrow R shown in FIG. 1, to move the cross member 14 and the uprights 12 to a location where they may not significantly interfere with a soccer goal 19 or a field as shown in FIG. 2.

Figure 3:
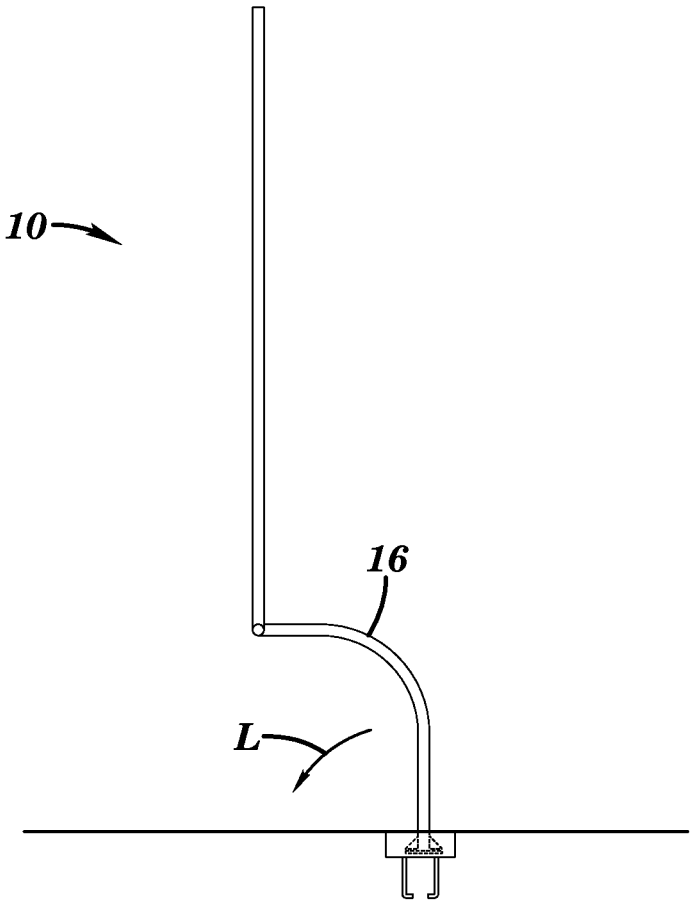
FIG. 3 is a side elevational view of the rotatable and hinged goal post shown in FIG. 1 with the goal post disposed in an upright orientation.
Figure 4:
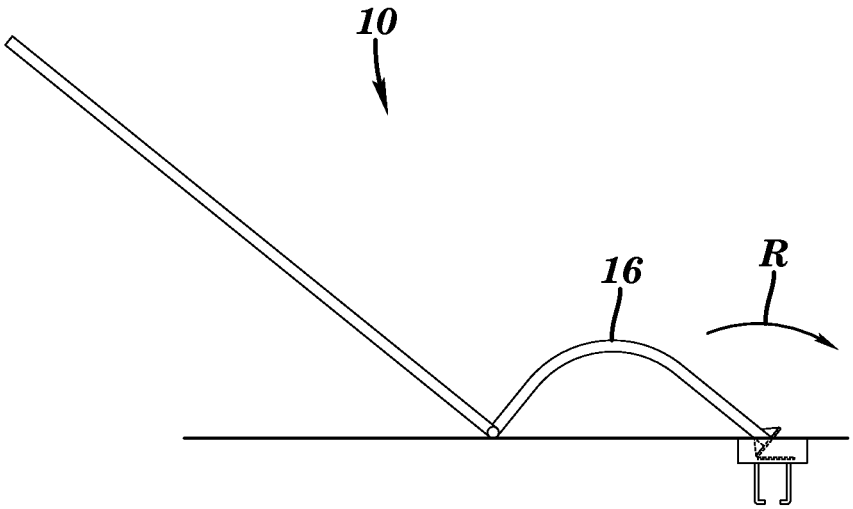
FIG. 4 is a side elevational view of the rotatable and hinged goal post shown in FIG. 1 with the goal post disposed in a lowered orientation.

With reference to FIGS. 3 and 4, goal post 10 may be operable configured, as described in greater detail below, and pivotable adjacent to the lower portion of the support member. For example, goal post 10 may be lowered from an upright orientation where the cross member is spaced-apart from the ground, in the direction of curved arrow L as shown in FIG. 3, to a lowered orientation with the cross member resting and in contact with the ground as shown in FIG. 4. Goal post 10 may be raised from a lowered orientation, in the direction of arrow R as shown in FIG. 4, to the upright orientation as shown in FIG. 3.

Figure 5:
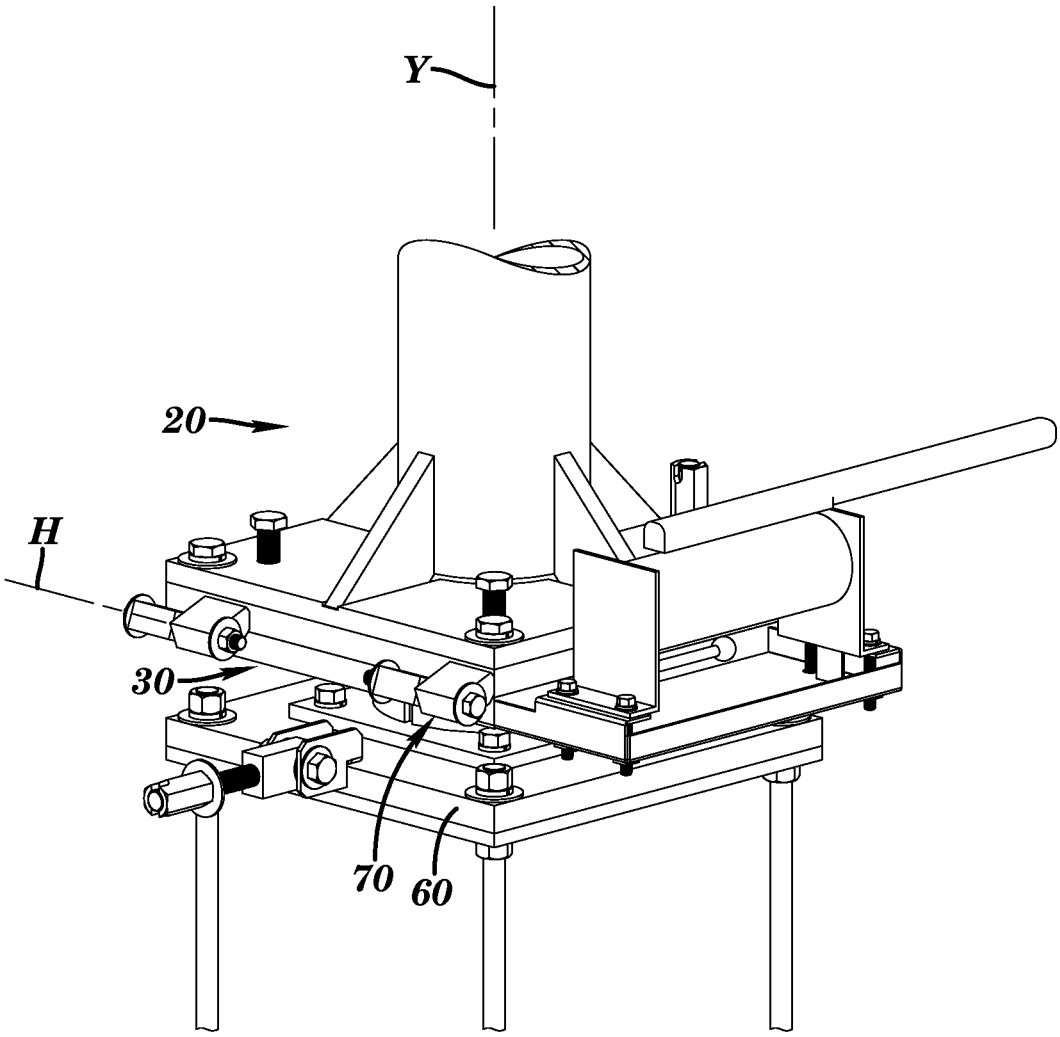
FIG. 5 is a perspective view of the lower portion of the rotatable and hinged goal post of FIG. 1 illustrating the rotatable and hinged assembly.

With reference to FIG. 5, goal post 10 (FIG. 1) may include a rotatable and hinged assembly 20, which allows the goal post to be rotatable about a vertical axis Y of the goal post, and pivotable about a hinge having an axis H at the base of the goal post. Rotatable and hinged assembly 20 may generally include a hinge assembly 30, a bottom plate 60, and a rotatable device 70 disposed therebetween.

Figure 6:
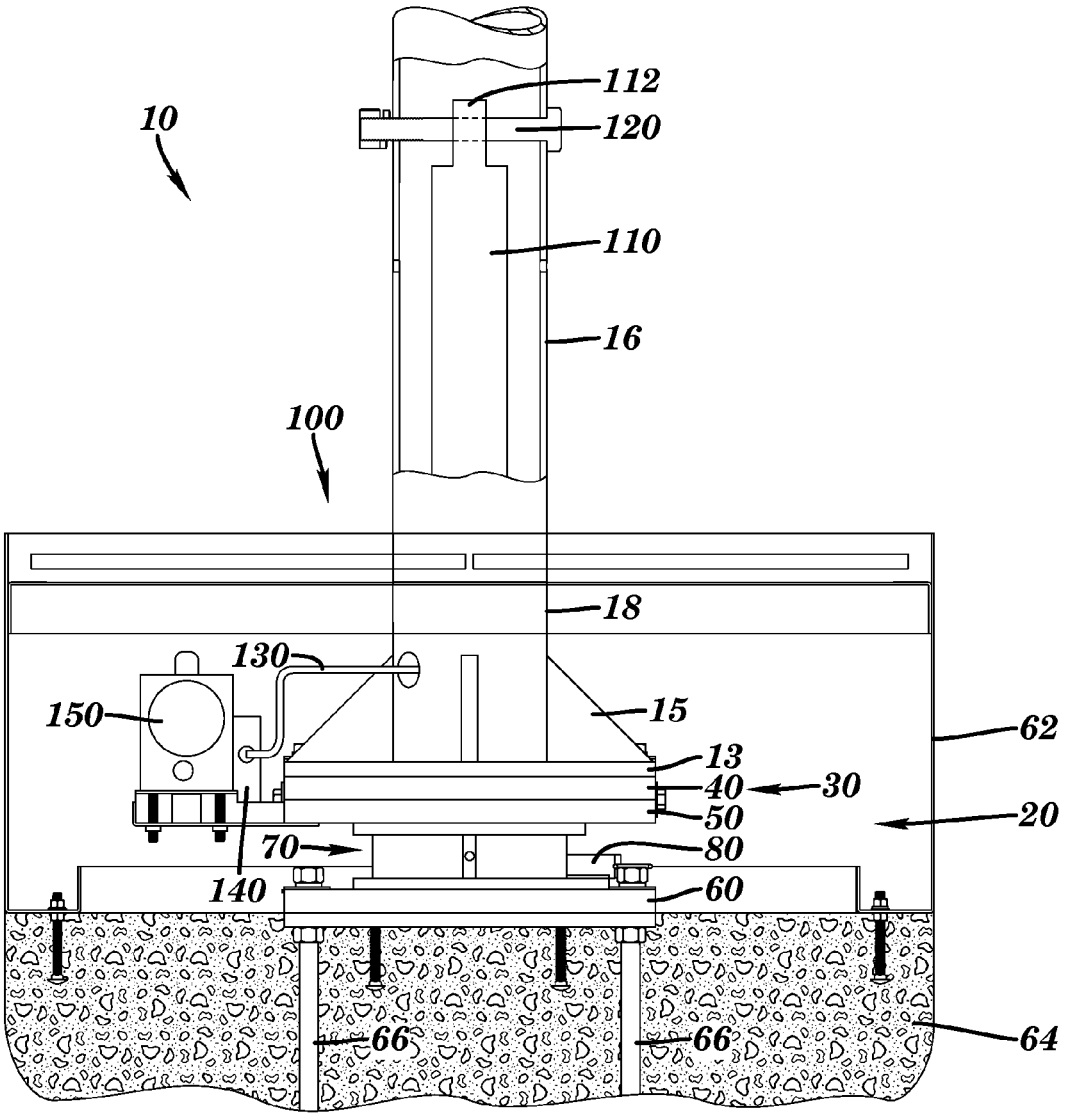
FIGS. 6 and 7 are side elevational views of the lower portion of the rotatable hinged goal post of FIG. 1 illustrating the rotatable and hinged assembly.
Figure 7:
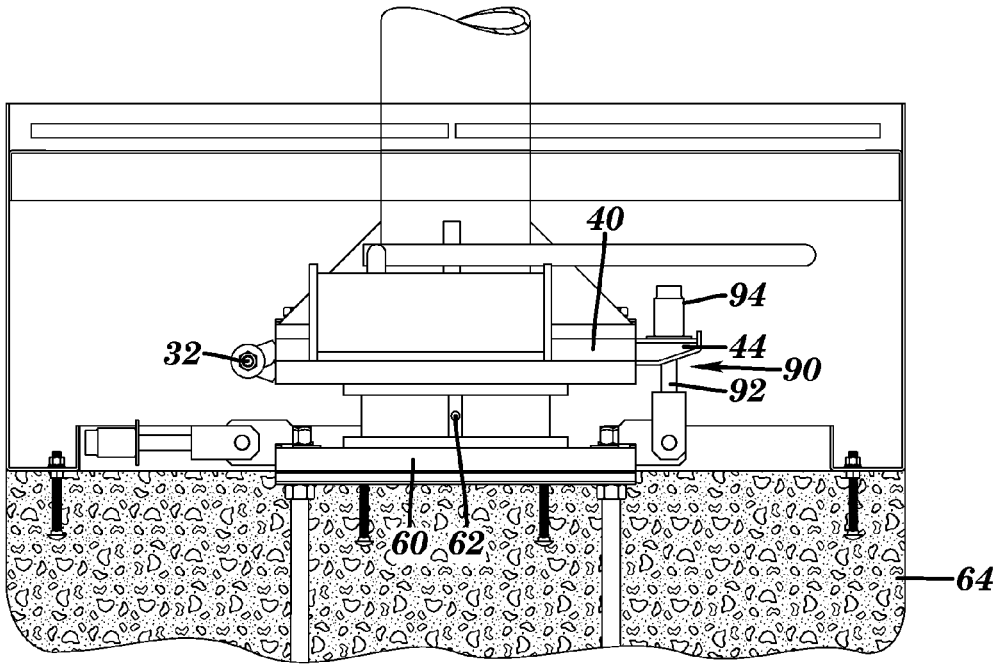
Figure 8:
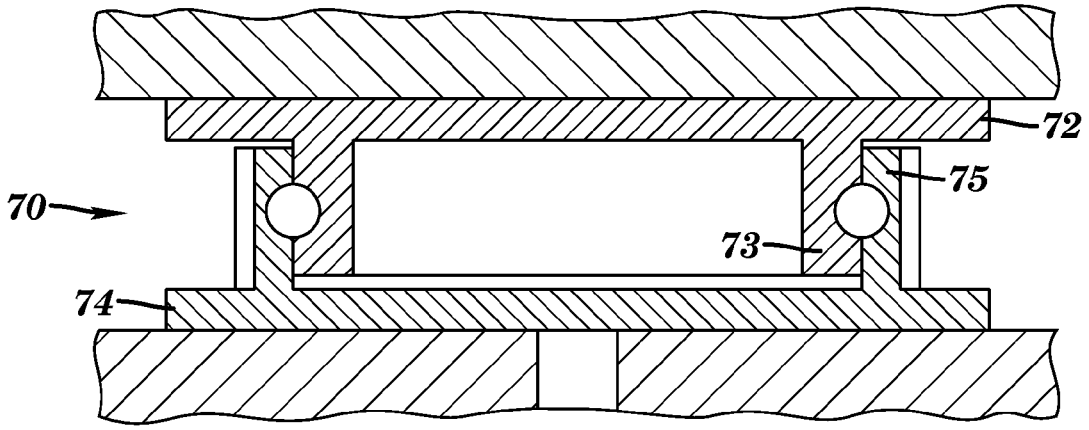
FIG. 8 is an enlarged cross-sectional side elevation view of the rotatable device of the rotatable and hinged assembly of FIGS. 6 and 7.

As shown in FIGS. 6 and 7, bottom plate 60 may be secured in and to the ground in an enclosure 62 via a concrete footing 64 and support bolts 66, two of which are shown disposed in the concrete. Rotatable device 70, as shown in FIG. 8, in one embodiment may include a bearing, for example, a ball bearing turntable assembly having an upper portion 72 having an inner downwardly-depending ring 73, and a lower portion 74 having an outer upwardly-extending ring 75. A plurality of rolling elements such as ball bearings may be disposed and/or sealed between the outer ring and the inner ring. With reference again to FIG. 6, the lower portion of the rotatable device may be fixedly attached to the bottom plate with bolts or by welding. The rotatable device may be operable to axially and radially support the weight of the goal post. A suitable rotatable device is available from RWM Casters, of Gastonia, N.C., model no. 114-6640K5-RWM. For example, the rotatable device may be a sealed bearing assembly which may provide easier rotation, and a simpler design which may result in a longer life than bearings having an interference fit even if an insert is provided to reduce friction. The bearings may be load bearing and enclosed in a hardened steel housing which can be bolted to the adjacent plates. It will be appreciated that other types of bearings may be suitably employed.

With reference still to FIG. 6, hinge assembly 30 may include an upper plate 40 and a lower plate 50 hingedly connected via a hinge 32 (best shown in FIG. 7) disposed along one side of the plates, which allows the goal post to be pivoted or lowered to the ground. Upper plate 40 may be operably connected to lower portion 18 of support member 16, e.g., the lower portion of the gooseneck. For example, upper plate 40 may be suitably bolted to a plate 13 which is attached, e.g., bolted to support member 16 with a plurality of gusset plates 15. It will be appreciated that other types of hinges may be suitably employed. From the present description, it will be appreciated by those in the art that it may be possible to hingedly attach the bottom of the gusseted base of the support member to the top of the bearing assembly, for example, where the hinge is disposed below the rotatable device. Lower plate 50 may be fixedly attached, e.g., bolted, to the upper portion of the rotatable device.

The hinge assembly 30 is rotatable relative to bottom plate 60. In addition, the rotatable and hinged assembly 20 may be locked to prevent rotation of the goal post relative to bottom plate 60 and the ground with a pull pin 80 fixedly operably attached to lower portion 74 (FIG. 8) and/or bottom plate 60. The pull pin may be a horizontally movable spring loaded pin positionable in locking holes 62 (best shown in FIG. 7) located at 90-degree intervals around the outer ring of the rotatable device. The pin once pulled from its normal locking position can be either locked by rotating the pin so that the pin does not engage the outer ring, or remains biased against the outer ring while the gooseneck rotates so that the spring loaded pin automatically locks into the next locking position at the 90-degree intervals.

As shown in FIG. 7, an eyebolt 90 includes a first end 92 pivotally attached to an edge of bottom plate 60 and a second threaded end 94 attachable with a nut and washer to at least one tab 44 having a slot which tab extends from an edge of upper plate 40 of the hinge assembly to lock the hinge assembly (and also aid in preventing rotation of the goal post). Additional tabs may be disposed along side edges of the upper plate of the hinge assembly.

Figure 10:
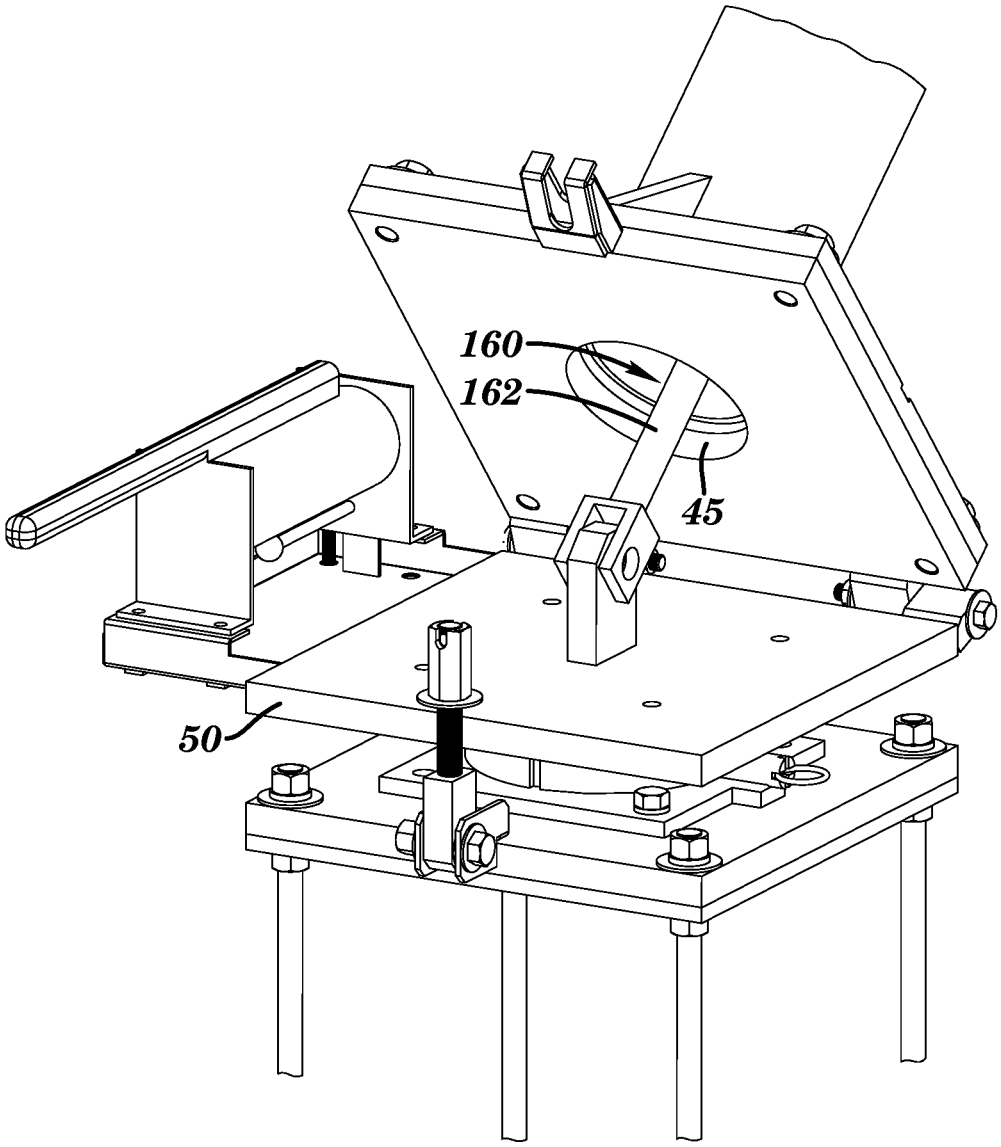
FIG. 10 is perspective view of the base of the goal post and the rotatable and hinged assembly disposed in a lowered orientation.

With reference again to FIG. 6, a controlled descent or lowering of the goal post, as well as a controlled raising of the goal post, is accomplished using an actuator 100 such as, for example, a cylinder 110 such as a hydraulic cylinder. The hydraulic cylinder may be mounted integrally with and inside the gooseneck of the goal post. For example, the cylinder may have an end 112 pivotally attached via a pin 120 to support member 16. As best shown in FIG. 10, a distal end 162 of a piston rod 160 may extend through an opening 45 in upper plate 40 and operably pivotally attach to lower plate 50. A suitable hydraulic cylinder is available from HydroAir Hughes, of Clarence, N.Y.

With reference again to FIG. 6, a pump 150 may be a manually operated pump for operating the cylinder to raise and lower the goal post. The manual pump may be mounted to lower plate 50 of the hinge assembly, and attached to the cylinder via a suitable line 130, such as a single hydraulic line. A pressure compensated flow regulator 140 may be fluidly coupled between the pump and the hydraulic line. This configuration reduces the complexity of piping the pump to the cylinder. A bar or tube attachable to the pump may be mounted on the inside of the enclosure during storage and operably attachable to the pump when in use. A jacking motion, similar to operating a car jack, may be used to operate the pump to raise the goal post.

Figure 11:
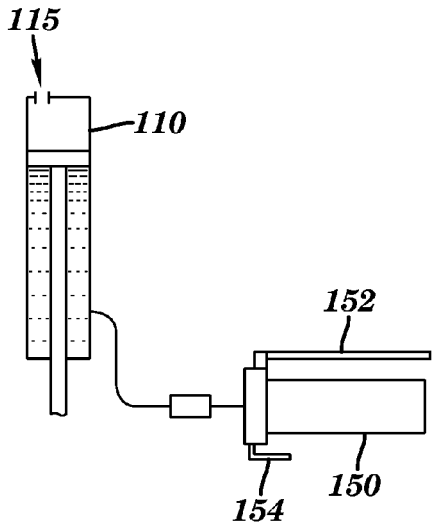
FIGS. 11-13 are diagrammatic illustrations of the hydraulic cylinder and pump corresponding to the goal post of FIG. 1 being in an upright position prior to being lowered, being lowered to a lowered position, and being raised to an upright position, respectfully.
Figure 12:
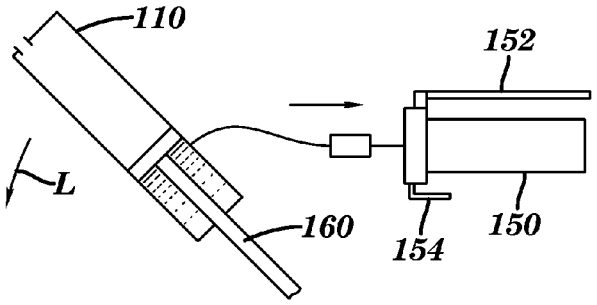
Figure 13:
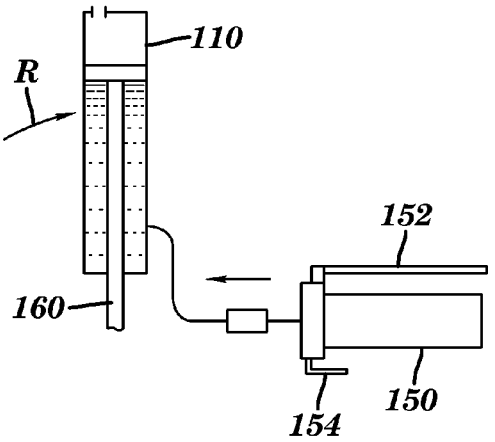

FIGS. 11-13 diagrammatic illustrate the cylinder and pump in an upright orientation prior to being lowered, being lowered to a lowered orientation, and being raised to an upright orientation, respectfully. As shown in FIG. 11, cylinder 110 includes a vent 115, pump cylinder 150 having a handle 152 and a release lever/handle 154, and pressure compensated flow regulator 140. The cylinder may also have a hose break valve utilized as a safety stop, located at the bottom of the cylinder in the gooseneck. For example, if the line, such as a hydraulic line, is ruptured and the flow exceeds a predetermined flow rate, the hose break valve will close. The release lever/handle located on the side of the pump assembly is used to lower the system and the pump handle is used to raise the goal post back up. A suitable pump is available from Hydro Air Hughes, of Clarence, N.Y., model no. HP61 DAH65. A suitable pressure compensated flow regulator is available from HydraForce of Lincolnshire, Ill., model number FR10-33. A suitable hose break valve may be integrated into a hydraulic cylinder, and is available from Hydro Air Hughes, of Clarence, N.Y., as a custom design.

As shown in FIG. 12, when the release lever/handle is opened the fluid pressure in the cylinder is transferred into pump cylinder 150 allowing piston rod 160 of the cylinder to extend the piston rod from the cylinder, thereby lowering the goal post in the directed of arrow L. The pressure compensated flow regulator provides a constant flow rate through the fluid line when lowering the goal post.

Figure 14:
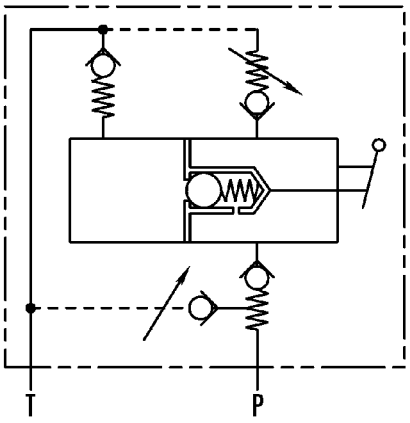
FIG. 14 is a schematic illustration the pump shown in FIGS. 11-13.

As shown in FIGS. 13 and 14, with a single hose system with a bypass built into the pump, when cylinder 110 is pressurized by pumping pump 150, the pressure forces piston rod to retract into cylinder 110 disposed in the gooseneck to raise the goal post in the direction of arrow R. In addition, the pump may include a double-acting piston so that the piston pumps fluid when the handle is pushed and pulled.

In another embodiment, a pump may be an electrically powered drive pump. For example, the electrically powered drive pump may be disposed on the gooseneck portion of the goal post and operably connected to the cylinder via fluid lines. For example, an operator may operably connect a portable power supply such as a battery to the electric drive pump for activating the electric pump, and thus raise and lower the goal post. Alternatively, the enclosure may include an outlet for supplying power to the electrically powered drive pump for raising and lowering the goal post. In addition, a pneumatically actuated cylinder and pump may be suitably employed. It will be appreciated by those skilled in the art that the pump may be disposed in the gooseneck portion of the goal post. From the present description, it will be appreciated that the actuator may be any device that takes energy, and converts that into motion for pivoting of the goal post.

Figure 9:
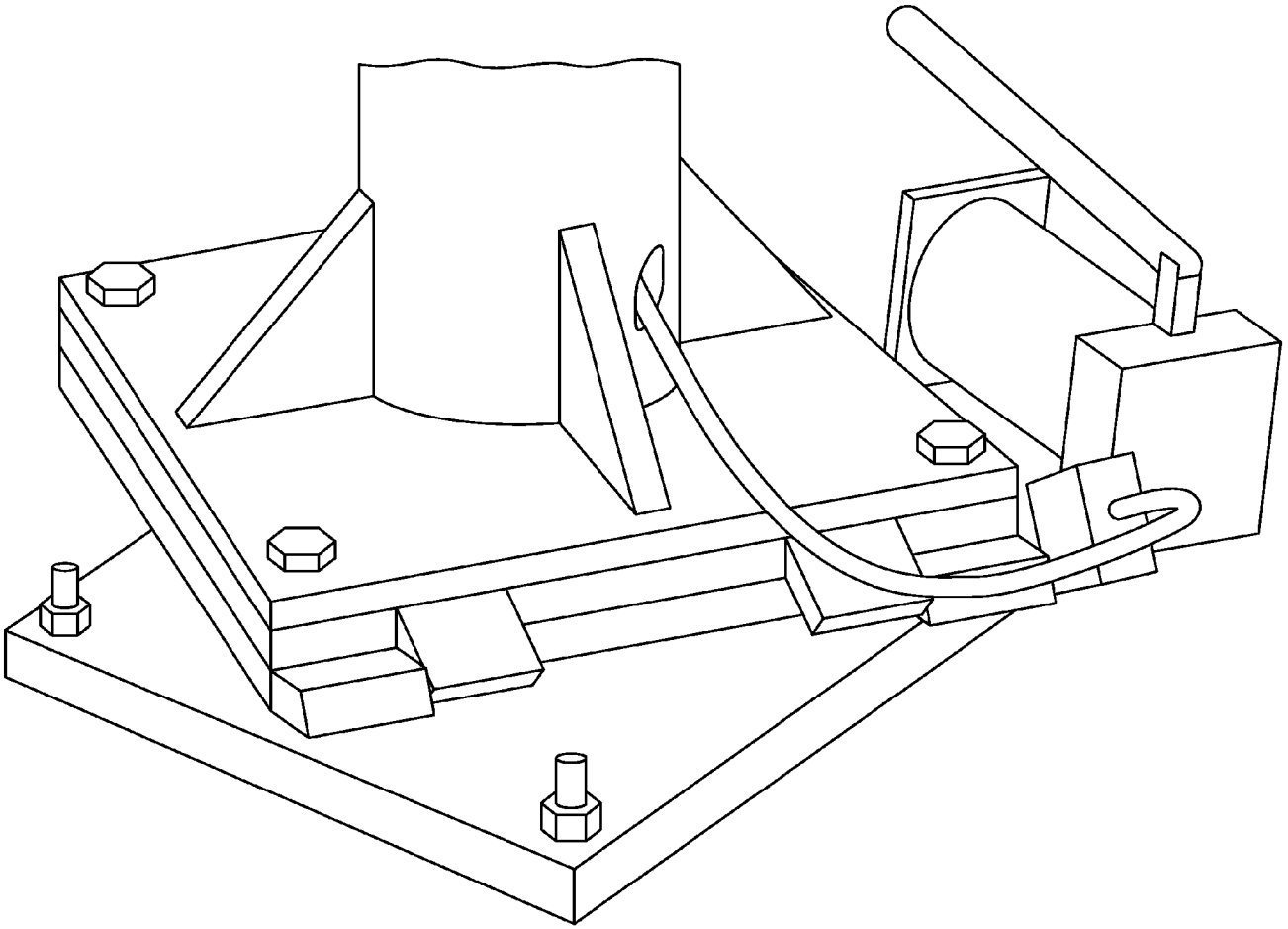
FIG. 9 is a perspective view of the lower portion of the rotatable hinged goal post of FIG. 1 illustrating the rotatable and hinged assembly being rotated.

In operation to rotate the goal post, an operator disengages the pull pin, and disengages the eyebolt. Thereafter, the operator can use and hold onto a distal end of the handle of the pump to apply leverage to rotate the goal post as the operator walks around the gooseneck as shown in FIG. 9. The rotatable device allows the gooseneck, crossbar, and upright assembly to be rotated by hand with minimal force. An operator may also use and hold onto a distal end of a tool such as a bar suitably attached to the gooseneck to apply leverage in rotating the goal post as the operator walks around the gooseneck. The bar may include the bar used to raise and lower the goal post.

With reference to FIG. 10, in operation to lower the goal post, the operator pumps the handle on the hydraulic pump to ensure pressure in cylinder then disengages the eyebolt.

Thereafter the operator utilizes the release lever/handle at the side of pump to actuate the valve to allow transfer of fluid to travel back into the pump (FIG. 12) which extends the cylinder and hence lowers the goal.

In operation to raise the goal post, as shown in FIG. 13, the operator reengages the release lever/handle which closes the valve allowing the operator to raise the goal by pumping the handle located on top of the pump. Once the goal post is orientated upright, the operator reengages the eyebolt securing the goal post.

Combining the above capabilities into one design for rotation about a vertical axis of the lower portion of the gooseneck of the goal post, and pivoting about a hinge disposed adjacent the bottom of the gooseneck of the goal post, allows either rotating or lowering, and to some degree providing additional flexibility if the operator or groundskeeper desires to lower the goal post in tighter venues, i.e. where there is limited space to drop the goal post to the rear, or to a side.

The rotational capability not only moves the crossbar away from the field of play when soccer is underway, but also solves a problem related to the lowering of the goal post to the ground. By combining rotation with the hinge mechanism, the goal post may first be rotated 90-degrees or 180-degrees then lowered onto the ground away from the playing field. This may be important because many times the reason to lower or drop down the goal post is to ward off fans and spectators from climbing the goal post at the end of a game.

The present invention provides a controlled lowering of the goal post by employing, for example, a cylinder and pump configuration which, allows for a controlled lowering of the goal post, typically between about 12 seconds to 14 seconds. The raising of the goal post may be about 80 seconds to about 120 seconds. The rotation and the pivoting of the goal post may be performed by one person.

From the present description, the placement of the rotatable device such as a ball bearing, and the hinge assembly may be switched, i.e., the rotatable device disposed above the hinge assembly to operably rotate and raise and lower the goal post. From the present description, it will also be appreciated by those skilled in the art that the conventionally fixed goal post may be retrofitted with a rotatable and hingable gooseneck or gooseneck portion incorporating the features of the present invention to which an existing goal post may be operably attached.

Thus, while various embodiments of the present invention have been illustrated and described, it will be appreciated to those skilled in the art that many changes and modifications may be made thereunto without departing from the spirit and scope of the invention.

The invention claimed is:

1. A rotatable and hingable goal post comprising;

a cross member;

a pair of spaced-apart uprights attachable to said cross member;

a support member having an upper portion and a lower portion, said upper portion attachable to said cross member;

a first plate attachable to an end of said lower portion of said support member;

a second plate fixedly attachable to the ground;

a third plate disposed between said first plate and said second plate;

a rotatable device comprising a bearing disposable between said third plate and said second plate;

a hinge operably attachable to said first plate and to said third plate;

an actuator operably attachable to said support member and disposed in said lower portion of said support member, and a portion of said actuator extending through an opening in said first plate and attachable to said third plate, said actuator comprising a hydraulic cylinder or a pneumatic cylinder;

a pump for actuating said actuator;

wherein said bearing, said hinge, a portion of said hydraulic cylinder or pneumatic cylinder, and said pump are positionable in an enclosure disposed below a surface of a playing field;

wherein said rotatable device is operable for rotating said rotatable goal post about said lower portion of said support member from a first position with said uprights disposed toward the playing field, and a second position with said uprights being disposed away from the playing field; and wherein said actuator is operable for controllably pivoting said goal post about an axis of said hinge from a first orientation with said uprights disposed vertically upward and said cross member spaced-apart from the ground, and a second orientation wherein said cross member is disposed and in contact with the ground, and said actuator is operable for controllably pivoting said goal post about said axis of said hinge from said second orientation to said first orientation.

2. The rotatable and hingable goal post of claim 1 wherein said bearing comprising a plurality of rolling elements.

3. The rotatable and hingable goal post of claim 2 wherein said pump comprises a manually operatable pump.

4. The rotatable and hingable goal post of claim 3 further comprising a pressure compensated flow regulator for controlling said actuator.

5. The rotatable and hingable goal post of claim 3 wherein said cylinder comprises a first end of said cylinder pivotally attachable to said lower portion of said support member, and a piston rod operably pivotally attachable to said third plate.

6. The rotatable and hingable goal post of claim 3 further comprising a plurality of gusset plates operably attached to said lower portion of said support.

7. The rotatable and hingable goal post of claim 3 further comprising a connecting member connectable to said first plate to inhibit pivoting of said hinge.

8. The rotatable and hingable goal post of claim 7 wherein said connecting member comprises an eyebolt.

9. The rotatable and hingable goal post of claim 2 further comprising a plurality of gusset plates operably attached to said lower portion of said support.

10. The rotatable and hingable goal post of claim 9 further comprising a connecting member connectable to said first plate to said second plate to inhibit rotation of said bearing.

11. The rotatable and hingable goal post of claim 10 wherein said connecting member comprises an eyebolt.

12. The rotatable and hingable goal post of claim 9 wherein said bearing is operable for rotating said goal post about 360-degrees about said lower portion of said support member.

13. The rotatable and hingable goal post of claim 1 wherein said rotatable device comprises a ball bearing turntable assembly having an inner ring and an outer ring, and a plurality of rolling elements disposed between said outer ring and said inner ring.

14. The rotatable and hingable goal post of claim 13 further comprising a locking means for locking said rotatable device.

15. The rotatable and hingable goal post of claim 13 further comprising a locking means for locking said hinge, and wherein said locking means further inhibits rotation of said rotatable device.

16. The rotatable and hingable goal post of claim 13 wherein said actuator is operably pivotally attachable to said third plate.

17. The-rotatable and hingable goal post of claim 13 wherein said pump comprises a manually operable pump.

18. The rotatable and hingable goal post of claim 13 wherein said actuator comprise said hydraulic cylinder.

19. The rotatable and hingable goal post of claim 13 further comprising a pressure compensated flow regulator for controlling said actuator.

20. The rotatable and hingable goal post of claim 1 further comprising a connecting member connectable to said first plate to said second plate to inhibit hingedly moving and rotating said goal post.

21. The rotatable and hingable goal post of claim 20 wherein said connecting member comprises an eyebolt.

22. The rotatable and hingable goal post of claim 1 wherein said bearing comprises a plurality of balls.

23. The rotatable and hingable goal post of claim 1 further comprising a locking pin for inhibiting rotation of said bearing.

24. The rotatable and hingable goal post of claim 1 wherein said actuator is operably pivotally attached to said third plate.

25. The rotatable and hingable goal post of claim 1 further comprising a plurality of gusset plates operably attached to said lower portion of said support.

26. The rotatable and hingable goal post of claim 1 wherein said cylinder comprises a first end pivotally attachable in said lower portion of said support member and a piston rod operably pivotally attachable to said third plate.

27. The rotatable and hingable goal post of claim 1 wherein said pump comprises a manually operable pump.

28. The rotatable and hingable goal post of claim 1 wherein said actuator comprise said hydraulic cylinder.

29. The rotatable and hingable goal post of claim 1 further comprising a pressure compensated flow regulator for controlling said actuator.

30. The rotatable and hingable goal post of claim 1 further comprising a first locking means for locking said rotatable device, and a second locking means for locking said hinge, and wherein said second locking means further inhibits rotation of said rotatable device.

31. The rotatable and hingable goal post of claim 1 wherein said rotating device is operable to allow rotation of said goal post at least 180-degrees around said lower portion of said support member.

32. The rotatable and hingable goal post of claim 1 wherein said rotating device is operable to allow rotation of said goal post about 360-degrees around said lower portion of said support member.

33. A method for moving a goal post, the method comprising:

providing the goal post of claim 1;

rotating the goal post about the support member from the first position to the second position;

operating the actuator to controllably pivot the goal post from the first orientation to the second orientation;

operating the actuator to controllably pivot the goal post from the second orientation to the first orientation; and rotating the goal post from the second position to the first position.

34. A method for moving a goal post, the method comprising:

providing the goal post of claim 1;

rotating the goal post from the first position to the second position; and rotating the goal post from the second position to the first position.

35. A method for moving a goal post, the method comprising:

providing the goal post of claim 2;

rotating the goal post about the support member from a first position with the uprights disposed toward a playing field to a second position with the uprights being disposed away from the playing field;

pivoting the goal post from a first orientation with the uprights disposed vertically upward and the cross member spaced-apart from the ground to a second orientation wherein the cross member is disposed and in contact with the ground;

pivoting the goal post from the second orientation to the first orientation; and rotating the goal post about the support member from the second position to the first position.

36. The method of claim 35 wherein the pivoting the goal post from the first orientation to the second orientation comprises operating the actuator to controllably pivot the goal post from the first orientation to the second orientation, and the pivoting the goal post from the second orientation to the first orientation comprises operating the actuator to controllably pivot the goal post from the second orientation to the first orientation.

37. A method for moving a goal post, the method comprising:

providing the goal post of claim 27;

rotating the goal post about the support member from the first position to the second position;

operating the actuator to controllably pivot the goal post from the first orientation to the second orientation;

operating the actuator to controllably pivot the goal post from the second orientation to the first orientation; and rotating the goal post from the second position to the first position.

38. A method for moving a goal post, the method comprising:

providing the goal post of claim 13;

rotating the goal post about the support member from the first position to the second position;

pivoting the goal post from the first orientation to the second orientation;

pivoting the goal post from the second orientation to the first orientation; and rotating the goal post from the second position to the first position.

39. A method for moving a goal post, the method comprising:

providing the goal post of claim 3;

operating the actuator to controllably pivot the goal post from the first orientation to the second orientation; and operating the actuator to controllably pivot the goal post from the second orientation to the first orientation.

* * * * *